United States Patent [19]

Arnett et al.

[11] Patent Number: 4,840,686

[45] Date of Patent: Jun. 20, 1989

[54] BAINITIC CORE GRINDING ROD

[75] Inventors: Charles R. Arnett, Kansas City, Mo.; James P. Bruner, Middletown, Ohio

[73] Assignee: Armco Inc., Middletown, Ohio

[21] Appl. No.: 178,404

[22] Filed: Apr. 6, 1988

[51] Int. Cl.[4] ..... C22C 38/22

[52] U.S. Cl. ..... 148/334; 148/320; 148/902; 241/170; 241/184

[58] Field of Search ..... 148/902, 334, 12 B; 241/170, 184

[56] References Cited

U.S. PATENT DOCUMENTS

| | | | |
|---|---|---|---|
| 3,895,972 | 7/1975 | Woodilla et al. | 148/12.1 |
| 4,016,009 | 4/1977 | Economopoulos et al. | 148/12 B |
| 4,016,015 | 4/1977 | Respen et al. | 148/320 |
| 4,023,988 | 5/1976 | Stickels et al. | 148/12.4 |
| 4,589,934 | 5/1986 | Glodowski et al. | 148/145 |

FOREIGN PATENT DOCUMENTS

| | | | |
|---|---|---|---|
| 0213917 | 3/1987 | European Pat. Off. | 148/12 B |
| 55-73849 | 6/1980 | Japan | 148/902 |
| 760510 | 4/1977 | South Africa . | |
| 582320 | 12/1977 | U.S.S.R. | 148/902 |

OTHER PUBLICATIONS

Simon et al., "Tempcore: A New Process for the Production of High-Quality Reinforcing Bars", *Iron and Steel Engineer,* Mar. 1984, pp. 53-57.

Reen-Hill, "The Iron-Carbon System", *Physical Metallurgy Principals 2 nd Edition,* 1973, pp. 681-687.

D. E. Nass, Steel Grinding Media in Production Use, Nov. 1975, pp. 33-41.

K. H. Z. Gahr, Relation Between Abrasive Wear Rate and the Microstructure of Metals, pp. 266-274.

T. E. Norman, Factors Influencing the Resistance of Steel Castings to High Stress Abrasion, 1958, pp. 187-196.

Y. J. Park et al., Effects of Manganese, Chromium, and Molybdenum on the Isothermal Transformation of Austenite in Eutectoid Steels, Jun. 1986, pp. 247-252.

*Primary Examiner*—Deborah Yee

*Attorney, Agent, or Firm*—R. J. Bunyard; L. A. Fillnow; R. H. Johnson

[57] ABSTRACT

A carbon or alloy steel heat treated grinding rod having improved wear resistance and breaking resistance for use in a rotating grinding mill. The surface of the rod has a martensitic microstructure having a hardness of at least HRC 55. The core of the rod has a bainitic microstructure having a hardness of at least HRC 40. A preferred rod composition includes at least 0.7% carbon, at least 0.25% of molybdenum, at least 0.25% chromium, less than 0.7% manganese, the balance iron and unavoidable impurities, all percentages by weight.

14 Claims, No Drawings

BAINITIC CORE GRINDING ROD

TECHNICAL FIELD

Our invention relates to an improved grinding rod for use in a conventional rotating grinding or rod mill wherein material such as ore, stone, coal and the like is comminuted. More specifically, the grinding rod of our invention is a carbon or alloy steel rod which is heat treated to have a hard microstructure in the outside surface of the rod and a softer microstructure in the core of the rod.

BACKGROUND OF THE INVENTION

Wear resistance of a steel grinding rod generally improves with increasing hardness. However, attempts in recent years to further increase hardness to improve wear resistance have been unsuccessful because the increase in hardness has resulted in greater failure rates. The microstructure of a conventional heat treated grinding rod has a martensite surface and a pearlite core. The core may have occasional regions of bainite and martensite due to rod centerline segregation. Increasing the hardness of these pearlitic core rods has resulted in high levels of breakage during the cascading action of the rods in a grinding mill. Failure by breaking can be longitudinal or transverse. A longitudinal break normally starts at either end of a grinding rod and propagates along the longitudinal axis. A transverse break can start at any position along the length of the rod and propagates perpendicularly to the longitudinal axis. Rod failure in a grinding mill is unacceptable because of increased costs due to rod consumption and downtime to remove broken rods from inside the mill. Accordingly, steel manufactures optimize the depth and hardness of martensite formation into the rod cross-section without increasing the hardness of the core in order to prevent breakage.

U.S. Pat. No. 4,589,934 discloses a steel grinding rod having 0.6–1% carbon, 0.7–1% manganese, 0.1–0.4% silicon, 0.15–0.35% molybdenum, 0.2–0.4% chromium, the balance iron, all percentages being by weight. The outer surface of the rod has a martensitic microstructure having a hardness greater than HRC 50 and a pearlitic core having a hardness of HRC 30–45. To minimize breakage, it is proposed to have soft rod end portions having a hardness of HRC 35–50. After being heated to an austenitization temperature, end portions of the rod are not quenched when cooling the rod to prevent formation of a high hardness martensite microstructure thereon.

Nevertheless, a long felt need remains to improve wear resistance of a grinding rod by increasing the surface hardness. Increasing a rod surface hardness to HRC 55 and above while maintaining a rod core hardness of about HRC 40 continues to result in high breakage rates.

SUMMARY OF THE INVENTION

We have determined that the hardness profile of a grinding rod can be increased without increasing breakage by retarding pearlite formation during transformation heat treatment when cooling from austenite. When pearlite in the microstructure of the rod core is minimized and replaced with bainite or bainite and martensite, the rod not only has improved wear resistance but also improved breaking resistance. The improved wear resistance occurs because the hardness profile across the rod cross-section is increased. Surprisingly, the breakage resistance actually improved over conventional rods having softer pearlitic cores.

An object of the invention is to increase the cross-section hardness of a grinding rod without increasing breakage of the rod during service.

A feature of the invention is to retard pearlite formation in the microstructure of the core during transformation heat treatment of the rod.

Another feature of the invention is to substantially eliminate pearlite from the microstructure of the core of a heat treated grinding rod.

Another feature of the invention is to form a heat treated grinding rod having a core whose microstructure is at least about 50% bainite.

Another feature of the invention is to form a heat treated grinding rod having a martensitic surface having a hardness of at least HRC 55 and a core having a microstructure of bainite, martensite and possibly unavoidable pearlite having a hardness of at least HRC 40.

An advantage of our invention is decreased costs because of increased wear resistance and longer life without an increase in breakage during service.

DETAILED DESCRIPTION OF THE PREFERRED EMBODIMENT

It will be understood steel grinding rods of the present invention are of an elongated configuration and may be fabricated from carbon or alloy steel continuously cast into a billet, round, or the like or ingot cast. Diameters typically range from about 75–125 mm and lengths may vary from about 3-6.5 meters.

When describing the microstructure and hardness, the cross-section of the grinding rod is referred to as having an outer surface and a core. By surface, it will be understood to means the annular outer region which occupies about 40–80% of the cross-sectional area of the grinding rod. By the core, it will be understood to mean the remaining annular inner region of about 60–20% of the cross-sectional area of the grinding rod.

Various steel chemistries can be used to achieve the improved results of the invention. The primary condition for the eutectoid or slightly hypereutectoid steel is to select an alloy composition whose continuous cooling curve from austenite forms a pronounced bainite "chin". When cooling a steel from austenite, it is known in the art molybdenum retards pearlite formation in the temperature range of 650° to 500° C. We have determined pearlite transformation can be minimized or avoided with slower cooling rates when quenching a grinding rod from an austenitization temperature. By proper selection of molybdenum and chromium, the microstructure of the rod core is formed of bainite or bainite and martensite with minimal or no pearlite. Accordingly, our preferred compositon includes at least 0.25 weight % molybdenum and at least 0.25 weight % chromium. A more preferred composition to prevent pearlite transformation includes at least 0.30 weight % molybdenum and at least 0.40 weight % chromium. Of course, it will be understood pearlite may not be completely eliminated from the core. For example, rods produced from castings having centerline segregation frequently have traces of unavoidable pearlite e.g. less than 10%.

The most widely used grinding rod diameters are 76, 89 and 102 mm. For these three sizes, our preferred chemistry ranges are:

| Diameter (mm) | Weight % Chromium | Weight % Molybdenum |
|---|---|---|
| 76 | .35-.45 | .31-.35 |
| 89 | .40-.50 | .33-.37 |
| 102 | .40-.50 | .35-.39 |

Hardenability and depth of hardness may be adjusted by lowering manganese to compensate for increased molybdenum. Accordingly, manganese preferably should be less than 0.7 weight %.

To better illustrate the invention, an experimental 150 metric ton electric furnace heat was produced having the following composition in weight %:

carbon=0.81
manganese=0.45
silicon=0.20
chromium=0.48
molybdenum=0.36
aluminum=0.03
balance iron and unavoidable impurities.

The heat was cast into 560 mm×560 mm ingots and rolled to 89 mm diameter rods. For test purposes, the rods were cut into lengths of 3800 mm and given two different conventional austenitization and quench heat treatments. For comparison, an alloy having a conventional composition was included.

Resulting Rockwell C hardness profiles across the cross-section of these alloys were as follows:

| | Hardness (HRC) | | |
|---|---|---|---|
| Sample | Conventional 1 | Invention 2 | Invention 3 |
| surface | 54 | 63 | 63 |
| 10 mm | 50 | 63 | 63 |
| 20 mm | 42 | 44 | 60 |
| 30 mm | 40 | 41 | 50 |
| center | 35 | 41 | 47 |
| AVH* | 47 | 54 | 59 |
| Core Micro-structure | 80-90% Pearlite <20% Marten-site | >80% Bainite <20% Martensite Trace Pearlite | >50% Bainite <50% Martensite |

*Average volumetric hardness

The core microstructure of conventional sample 1 was predominantly pearlite having some martensite. Samples 2 and 3 are examples using the chemistry provided above the invention including sufficient molybdenum and chromium to alloy a heat treated grinding rod to have a composite microstructure in the core of bainite, martensite and unavoidable pearlite. Preferably, the core is primarily bainite with the balance martensite. Sample 2 had a martensite surface having a hardness of HRC 63. The core was mostly bainite with less than 20% martensite having a minimum hardness of HRC 41. Testing of rods of sample 2 in an actual production rod mill indicated a dramatic decrease in wear rate of nearly 20% over that of conventional rods of sample 1. Sample 3 had a core that was at least 50% bainite with the balance martensite. No pearlite was apparent. It will be noted that both samples of the invention have significantly higher average volumetric hardnesses than the conventional grinding rod steel in sample 1. Attempts to increase surface hardness of pearlitic core grinding rods resulted in high breakage rates when the rods were placed in service. Furthermore, increasing surface hardness does not increase the core hardness because a hardness of about HRC 40 is about maximum for pearlite in a steel having 0.8 weight % carbon.

To further compare the effect of the higher hardness profile, rods of sample 2 of the invention and sample 1 having a pearlitic core were compared using a standard 3-point bend test. The average breaking load of rods having a higher hardness profile and a bainite-martensite composite core according to the invention was 233,000 lbs (105,800 kg) and the average breaking load for rods having a predominantly pearlite core was 203,000 lbs (92,200 kg). That is to say rods made according to our invention had about 15% higher breaking strength than conventionally made rods having a predominantly pearlitic microstructure in the core.

Production size grinding rods made in accordance with the invention (sample 2) were evaluated experimentally in a marked rod test in a production grinding mill processing copper ore. After 733 test hours, the average diameter loss for these rods was 19.8% less than that for conventionally produced rods (sample 1) present in the grinding mill.

The novel grinding rod microstructure disclosed herein was obtained using conventinal heat treatment practice. For example, column 5 and Table 1 of U.S. Pat. No. 4,589,934; incorporated herein by reference, discloses the heat treatment used for making our improved grinding rod. Of course, it will be understood the starting austenitization temperature and final equalization temperature can be varied depending upon the amount of bainite and rod profile hardness desired.

It will be understood various modifications can be made to our invention without departing from the scope and spirit of it. The composition can be varied so long as the core has a microstructure of bainite or bainite and martensite formed during transformation cooling from the austenite phase. The starting material for the grinding rod could be an as-cast round that is continuously cast to the final diameter. Alternatively, the grinding rod could be hot rolled from originally continuously cast or ingot cast shapes. Heat treatment or hardening of the rod could occur in-line following continuous casting or hot rolling. Alternatively, the rod could be allowed to cool with subsequent heat treatment occurring as a separate processing step. Depending upon the chemistry and heat treatment, the microstructure of the surface and core of the rod could both be mostly bainite. Therefore, the limits of our invention should be determined from the appended claims.

We claim:

1. A grinding rod for use in a rotating grinding mill, comprising:

a heat treated carbon or alloy steel grinding rod having a surface and a core, said surface having a hardness of at least about HRC 55, said core having a bainitic microstructure having less than 10% pearlite and a hardness of at least about HRC 40 wherein said rod has improved wear resistance and improved breaking resistance.

2. The rod of claim 1 wherein the microstructure of said surface is substantially martensite.

3. A grinding rod for use in a rotating grinding mill, comprising:

a heat treated carbon or alloy steel grinding rod having a surface and a core, said surface having a hardness of at least about HRC 55, said core having a microstructure that is at least about 50% bainite and a hardness of at least about HRC 40 wherein said rod has improved wear resistance and improved breaking resistance.

4. The rod of claim 3 wherein the microstructure of said surface is substantially martensite.

5. A grinding rod for use in a rotating grinding mill, comprising:

a heat treated carbon or alloy steel grinding rod having a surface and a core, said surface having a microstructure that is substantially martensite, said core having a composite microstructure consisting essentially of bainite and martensite wherein said rod has improved wear resistance and improved breaking resistance.

6. A grinding rod for use in a rotating grinding mill, comprising:

a heat treated carbon or alloy steel grinding rod having a surface and a core, said surface having a microstructure that is substantially martensite having a hardness of at least about HRC 55, said core having a microstructure that is at least about 50% bainite having a hardness of at least about HRC 40 wherein said rod has improved wear resistance and improved breaking resistance.

7. The rod of claim 6 wherein said surface has a hardness of at least about HRC 60.

8. The rod of claim 6 including at least 0.25 weight % molybdenum.

9. The rod of claim 8 including less than 0.7 weight % manganese.

10. The rod of claim 8 wherein said core is substantially free of pearlite.

11. A grinding rod for use in a rotating grinding mill comprising:

a heat treated carbon or alloy steel grinding rod having a surface and a core, said rod including at least about 0.7% carbon, at least about 0.30% molybdenum, at least about 0.30% chromium, less than about 0.7% manganese, all percentages by weight, said surface having a microstructure that is substantially martensite having a hardness of at least about HRC 60, said core having a microstructure that is at least about 50% bainite having a hardness of at least about HRC 40 wherein said rod has improved wear resistance and improved breaking resistance.

12. The rod of claim 11 wherein said core is substantially free of pearlite.

13. A grinding rod for use in a rotating grinding mill, comprising:

a heat treated carbon or alloy steel grinding rod having a surface and a core, said rod including at least 0.7 weight % carbon, at least 0.25 weight % chromium, at least 0.25 weight % molybdemun, and less than 0.7 weight % manganese, said surface having a microstructure that is substantially martensite having a hardness of at least about HRC 55, said core having a microstructure that is at least abut 50% bainite having a hardness of at least about HRC 40 wherein said rod has improved wear resistance and improved breaking resistance.

14. A grinding rod for use in a rotating grinding mill, comprising:

a heat treated carbon or alloy steel grinding rod having a surface and a core, said rod including at least 0.40 weight % chromium, at least 0.30 weight % molybdenum, and less than 0.7 weight % manganese, said surface having a microstructure that is substantially martensite having a hardness of at least about HRC 60, said core having a microstructure that is at least about 50% bainite having a hardness of at least about HRC 40 wherein said rod has improved wear resistance and improved breaking resistance.

* * * * *